US006202758B1

(12) United States Patent
Jenne

(10) Patent No.: US 6,202,758 B1
(45) Date of Patent: Mar. 20, 2001

(54) COMPACT BORING APPARATUS FOR MAKING EARTH BORES

(75) Inventor: Dietmar Jenne, Strengelbach (CH)

(73) Assignee: Terra AG Fuer Tiefbautechnik, Strengelbach (CH)

( * ) Notice: Subject to any disclaimer, the term of this patent is extended or adjusted under 35 U.S.C. 154(b) by 0 days.

(21) Appl. No.: 09/255,118

(22) Filed: Feb. 22, 1999

(30) Foreign Application Priority Data

Oct. 29, 1998 (DE) ..... 198 49 963

(51) Int. Cl.[7] ..... E21B 7/20; E21C 11/00
(52) U.S. Cl. ..... 173/34; 173/141; 173/152
(58) Field of Search ..... 173/141, 152, 173/4, 19, 13, 11, 145, 34

(56) References Cited

U.S. PATENT DOCUMENTS 1,824,480 * 9/1931 Gartin ..... 173/141
2,066,927 * 1/1937 Curtis ..... 173/141
2,219,717 * 10/1940 Swahnberg ..... 173/152
2,318,760 * 5/1943 Curtis et al. ..... 173/141
3,273,658 * 9/1966 Ytterfors ..... 173/141
4,932,481 * 6/1990 Wechner ..... 173/141
5,431,234 * 7/1995 Klemm ..... 173/152

FOREIGN PATENT DOCUMENTS 196 45 222 5/1998 (DE) .

* cited by examiner

*Primary Examiner*—Scott A. Smith
(74) *Attorney, Agent, or Firm*—McCormick, Paulding & Huber LLP

(57) ABSTRACT

An earth boring machine 10 with a frame and a linearly movable slide 22 on the frame has an apparatus for holding and rotationally driving a boring rod 24, and a forward feed drive for moving the slide parallel to the boring direction. The machine with especially small space requirement creates a large force for movement of the slide 22 in and opposite to the forward feed direction. Moreover, the forward feed drive of the earth boring machine 10 has a rotationally drivable forward feed spindle 20 arranged on the frame 18, which spindle is received by a spindle nut non-rotationally connected with the slide 22.

7 Claims, 5 Drawing Sheets

COMPACT BORING APPARATUS FOR MAKING EARTH BORES

FIELD OF THE INVENTION

The invention concerns an earth boring machine with a frame, a slide linearly movable on the frame, which slide has an apparatus for holding and rotatably driving a boring rod, and a forward feed drive for moving the slide parallel to the boring direction.

BACKGROUND OF THE INVENTION

In the creation of an earth bore, the forward feed drive of such an earth boring machine moves the slide relatively slowly forwardly against a large force exerted by the earth, which force is transmitted to the slide through the boring rod. Previous earth boring machines have for the forward feed drive a cylinder arranged on the frame from which a piston is moved outwardly in its axial direction to push the slide forwardly. A disadvantage is that in such a drive, during the extension and retraction of the piston respectively, greatly different forces are created. The maximum force can therefore be deployed only either for the creation of a bore or for the pulling of the boring rod from the bore.

If the piston becomes fully extended, the boring rod is disconnected from the slide and thereafter the piston is retracted with the slide also being retracted on the frame oppositely to the forward feed direction. Thereafter, an additional rod member is fastened with one end to the slide and with its other end to the boring rod, before the piston is again driven forwardly to extend the bore. The frame of such earth boring machines extends at least over the length of the cylinder with its piston extended, and therefore, at least over double the length of a rod member. Where only little room is available for placement of the frame, such an earth boring machine cannot be used.

The frames of such earth boring machines can be built with shorter length. The publication DE 196 45 222 A1 discloses an earth boring machine on the frame of which is arranged a forward feed drive, and chains and chain wheels for driving a slide, which slide is fastened to an upper run of one of the chains. Such a construction requires a forward feed drive of high power for driving the slide at a low rotational speed and a large rotary moment. Therefore, arranged on the frame is an especially high power motor with a speed reducing drive which is expensive and requires a large amount of room.

If the chains are driven by an hydraulic motor, there arises the disadvantage that the hydraulic motor when operating at low rotational speeds has a very poor efficiency. This means that, especially in the case of hard earths, which demand a slow forward feed, the maximum rotational moment of the hydraulic motor becomes indeed needed but, because of the slow rotational speed, it cannot be used.

Further, during the forward feed of the slide against the resistance of the earth, large forces come into effect between the chain and the slide. This requires the use of especially robust chains and chain wheels likewise requiring much space so they are also disadvantageous in regard to constructional size and/or the space requirement of such compact boring mechanisms.

It is the object of the invention to provide an earth boring machine of the above kind which with an especially small space requirement creates in a simple way a large force for moving the slide in and opposite to the forward feed direction.

SUMMARY OF THE INVENTION

This object is solved by an earth boring machine in which the forward feed drive has a rotationally drivable forward feed spindle arranged on the frame, which spindle is received by a spindle nut non-rotatably fixed to the slide.

The use of a forward feed spindle and a spindle nut for the drive of the slide in the earth boring machine of the invention has the advantage that the driving rotational moment by way of the forward feed spindle and the spindle nut is converted directly into a forward feed force exerted onto the slide. A drive motor creates with its power a rotary moment which drives the forward feed spindle in a rotational motion at a given rotational speed. The pitch of the threads of the forward drive spindle, in the case of a given motor power and rotational speed, determines the forward feed force and the forward feed speed of the slide. The smaller the pitch of the thread, the smaller is the forward feed speed and the larger the forward feed force of the slide.

According to the inventive idea, the pitch of the forward feed spindle is so designed that the forward feed speed of the slide is very small and the forward feed force transmitted to it very large. Both of these values can be changed by the use of other forward feed spindles and spindle nuts with other thread pitches, and thereby the particular requirements of a current boring process can be accommodated. These advantageous effects are achieved without the use of a separate speed reducing drive. The frame of the earth boring machine can therefore be made in an especially space-saving way.

In a preferred embodiment of the inventive earth boring machine, the slide is movable relative to the spindle nut along an axial extent which is at least so long as the axial length of a thread for connecting two rod members and which axial extent is limited by stops fixed to the slide. During the emplacement and removal of a rod member between the boring rod and the slide, there appears between the boring rod and the slide axially directed tension or compressive forces. During the threading on of an additional rod member, for example, there is exerted on to the threads of the receiver of the slide a force in the forward feed direction and onto the thread of the boring rod an oppositely directed force. Because of the high resistance of the boring rod sticking into the earth on one hand and the spindle nut on the other hand against an axial movement when the forward feed drive is at rest, there exists the danger that the threads on the boring rod and on the receiver are abraded by the high axial forces during the threading of the parts to one another or from one another. In the preferred embodiment, the slide gives way against the tension or compression force applied to it through the receiver and during the making or loosening of the threaded connection is driven relative to the fixed in place spindle nut axially along a stretch of displacement. In this way, damage to the threads is avoided. The length of the movable stretch corresponds about to the length of the threads and is limited by axial stops fixed to the slide. These stops transmit therefore the forward feed force from the spindle nut to the slide when the forward feed drive is in operation.

This embodiment can be optimized by pre-tensioning the slide by means of a tension element in one of the axial stop positions. Thereby the movement of the slide relative to the spindle nut either during the threading from one another or the threading to one another of the receiver and the rod member is supported and the tension or compression force is reduced.

In this case, it is especially advantageous if the slide is pre-tensioned in the direction of the forward movement of the boring rod, by a helical spring designed as a compression spring surrounding the forward feed spindle and working between the spindle nut and, for example, the axially forward stop. In this way, for one thing, the insertion of an additional rod member is made easier. The slide is first driven in the forward feed direction until the threads of the rod member and the receiver come into contact with one another. Then the spindle nut is moved further against the force of the compression spring for about the length of the threads. The thereby existing tension of the spring is then used itself for the forward pushing of the slide while the threads of the receiver are threaded with those of the rod member by actuation of the rotary drive. An interruption of the actuation of the rotary drive, in order to relieve the slide from tension forces during the threading together of the windings with the help of the forward feed drive, is not necessary.

As another thing, the threads of the spindle nut and of the spindle are protected against the direct effect of impacts directed in the forward feed direction, which impacts may appear if the borer encounters relatively large stones. These short-term impulses are conveyed from the boring rod through the slide to the forward axial stop and push the slide against the forward feed direction and against the force of the compression spring, which is thereby compressed. At the same time, the compression spring increases the forward feed force exerted onto the slide and supports the borer in overcoming the encountered obstacle. The spindle nut and spindle do not become loaded with additional axial force.

In a further embodiment, a forward feed motor is arranged in line with the longitudinal axis of the forward feed spindle for the direct rotational drive of the forward feed spindle. With this arrangement, the rotational moment of the forward feed motor is transferred directly and without loss to the forward feed spindle.

In another preferred embodiment of the inventive boring mechanism, a forward feed motor for the rotational drive of the forward feed spindle is arranged laterally of the longitudinal axis of the spindle and is connected with the spindle through a drive. By this arrangement of the forward feed motor laterally of the forward speed spindle, the extent of the frame of the boring mechanism in the direction of the spindle axis is especially small.

In a further preferred embodiment, the forward drive spindle is surrounded by a concave cone spring (telescopic spring) or by a bellows. In this way the forward drive spindle is protected from becoming dirty without the movement of the slide being hindered.

In another preferred embodiment, the threads of the forward drive spindle and of the spindle nut are formed in profile like ball bearing races and in the interior of the spindle nut are filled with balls. Because of the relatively low rolling frictional forces between the balls and the threads of the spindle nut and the forward drive spindle, the loss of rotational drive moment is reduced, in comparison to the substantially higher sliding frictional forces which would exist between the threads of the forward drive spindle and the spindle nut in the absence of this bearing.

In a further embodiment, a ball bearing is provided for supporting each of the ends of the forward feed spindle on the frame. The ball bearings absorb axial as well as radially-directed forces and are especially saving in space.

Further features and advantages of the invention will be apparent from the following description of an exemplary embodiment of the inventive earth boring machine taken in connection with the accompanying drawings:

DESCRIPTION OF THE PREFERRED EMBODIMENT

Figure 1:
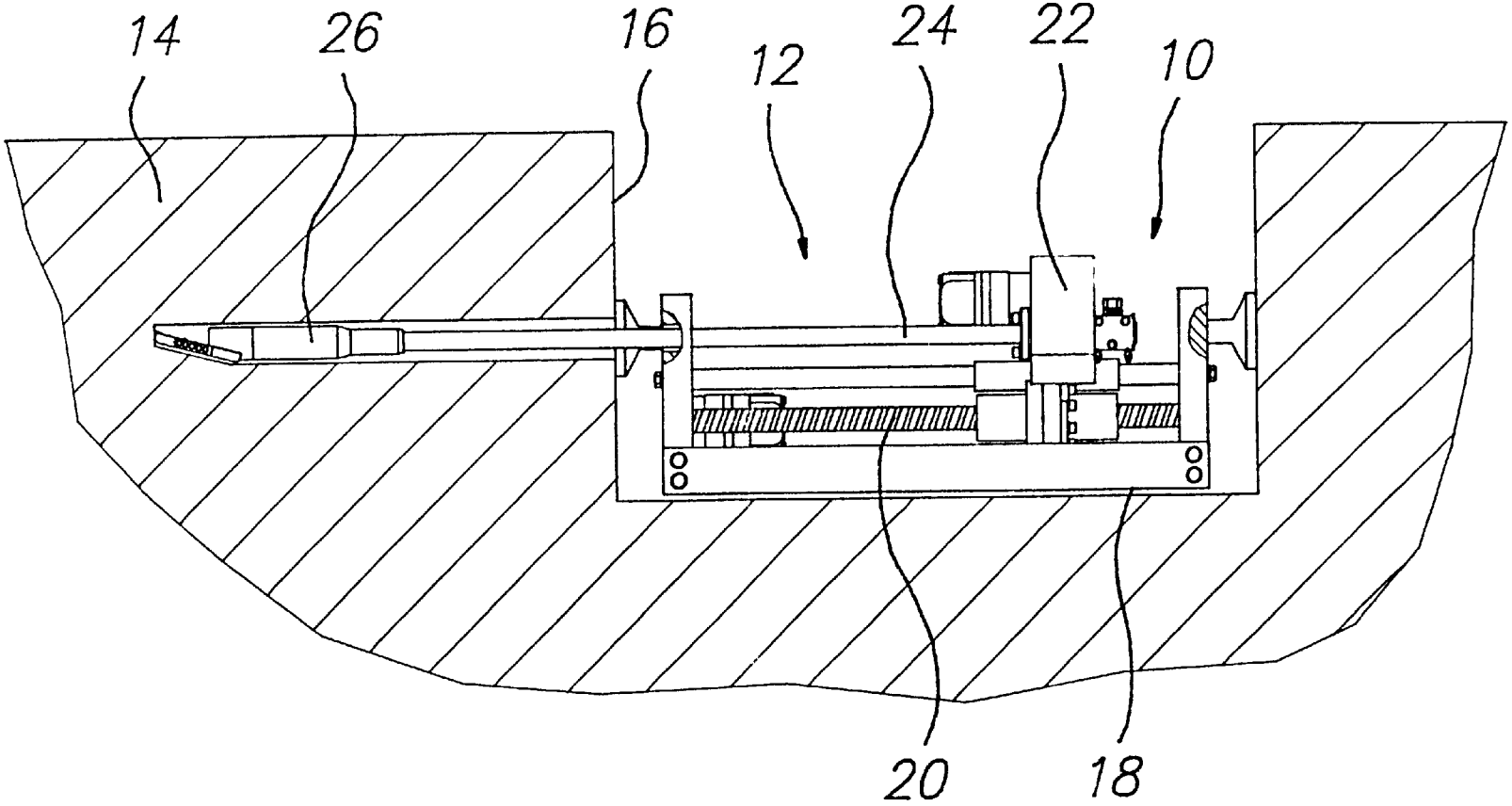
FIG. 1 a simplified side view of the boring machine.

FIG. 1 shows a simplified side view of an earth boring machine 10 with a pit carriage 12, which is set up in a dug starting pit 16 in the earth 14. The pit carriage 12 has a frame 18 with a forward feed spindle 20 connected with a slide 22 to which the rear end of a boring rod 24 is fastened. The boring rod 24 extends with its boring head 26 essentially horizontally outwardly from the frame 18 into the earth 14.

Figure 2:
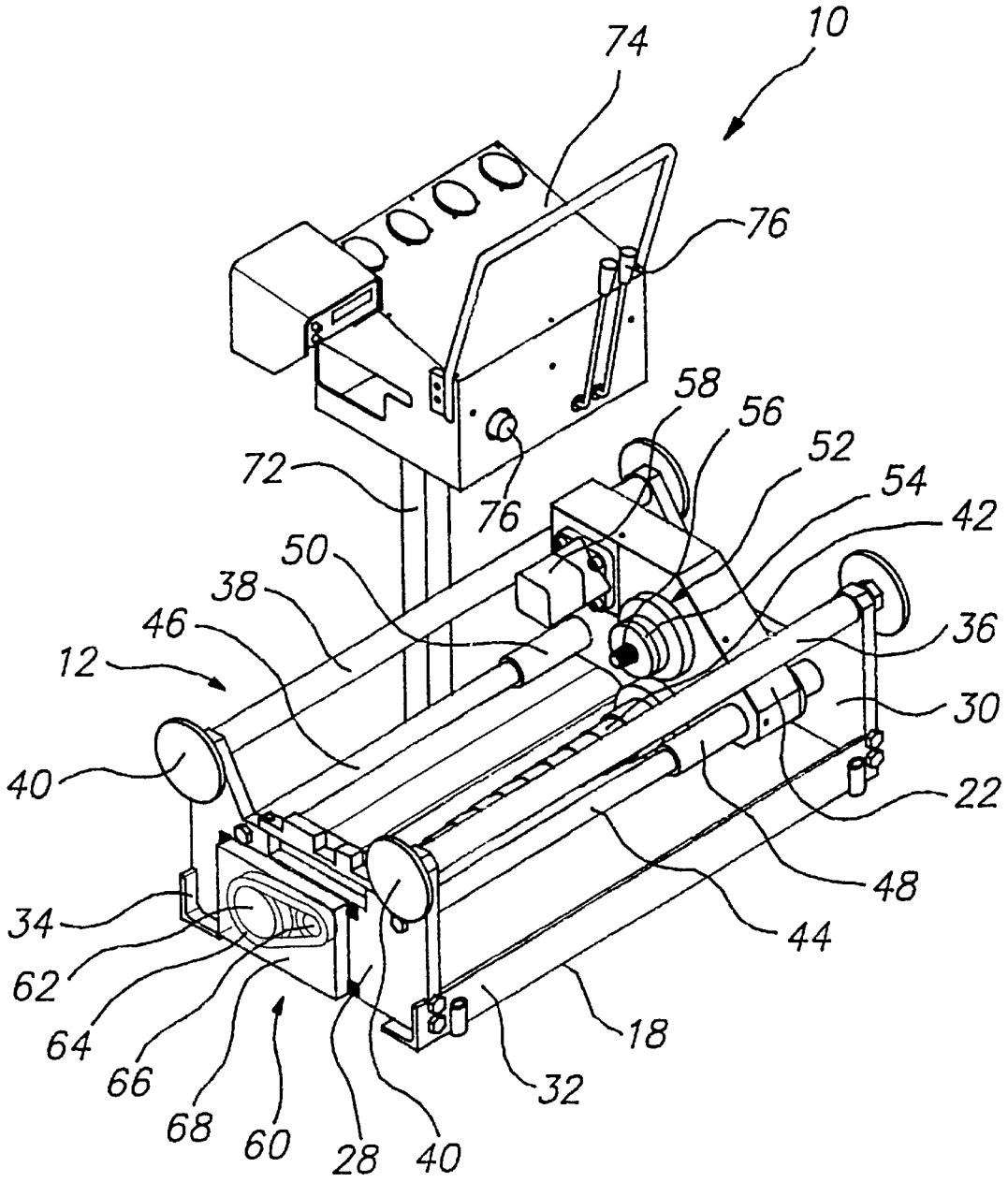
FIG. 2 a perspective illustration of the boring machine.

FIG. 2 shows a detailed perspective view of the earth boring machine 10 without the boring rod 24. The frame 18 of the pit carriage 12 has a forward wall 28 and a rear wall 30. These walls are rigidly connected, at their lower lateral sections, by two rectangular profile bars 32 and 34 extending between the walls, and at their upper lateral sections by two adjustable length tension struts 36 and 38, which with their dish-shaped end surfaces 40 brace the frame 18 of the earth boring machine 10 against the walls of the starting pit 16 (see FIG. 1). The forward feed spindle 20 is rotatably supported on the walls 28 and 30.

Further, two cylindrical guide rails 44 and 46 extend between the forward wall 28 and the rear wall 30 on both sides of and somewhat above the forward feed spindle 20, which guide rails, as illustrated in FIG. 2, are surrounded by a cover 42 in the form of a concave cone spring. A slide 22 of nearly rectangular shape is supported on the guide rails 44 and 46 for sliding movement along the length of the spindle axis. Two hollow cylinders 48 and 50, which receive the guide rails 44 and 46, and which are rigidly connected with the body of the slide, extend in the axial direction through the slide 22 near the lower lateral ends of its body. The connection of the slide 22 with the forward drive spindle 20 is described below in connection with FIG. 4 through FIG. 7.

On the slide 22 above the forward feed spindle 20 is arranged a rod receiver 52 with a rotatable threaded pin 56 fastened to a bearing 54 and extending in the forward feed direction. The boring rod 24 is tightly screwed onto the threaded pin 56. For the rotary drive of the boring rod 24, the rod receiver 52 is connected with a rotary drive motor 58 by means of a non-illustrated drive, which motor is fastened to the side of the slide facing in the forward feed direction laterally of the rod receiver 52.

For the rotary drive of the forward feed spindle 20, on the side of the forward wall 28 facing in the forward feed direction is provided a chain drive 60 with a drive wheel 62, a chain 64, and drive wheel 66. The drive wheel 66 is non-rotatably connected with the forward end of the forward feed spindle which extends forwardly through and beyond the forward wall 28. To avoid dirt, the chain drive 60 is surrounded from outwardly in by a protective cover 68 fastened to the forward wall 28.

The drive wheel 62 of the chain drive 60 is connected with a forward feed motor 70 which, in the illustration of FIG. 2, is not visible and which is described in more detail below in connection with FIG. 3.

On the frame 18 of the pit carriage 12 is a vertically extending carrier 72 for a control console 74 for controlling the functions of the earth boring machine. The carrier 72 is hollow and carries the non-illustrated control conductors for connecting the operating elements 76 of the control console 74 with the drive apparatuses of the pit carriage 12.

Figure 3:
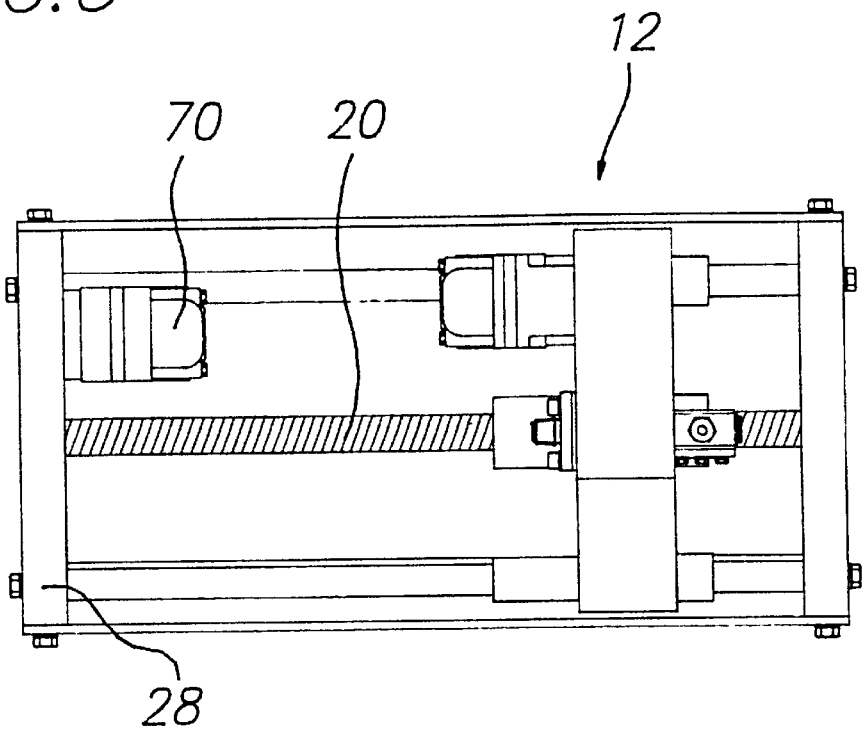
FIG. 3 a plan view of a pit carriage of the boring machine.

FIG. 3 shows in a simplified plan view the pit carriage 12, to which the forward feed motor 70 for rotatably driving the forward feed spindle 20 is fastened laterally of the forward feed spindle on the side of the forward wall 28 facing opposite to the forward feed direction.

Figure 4:
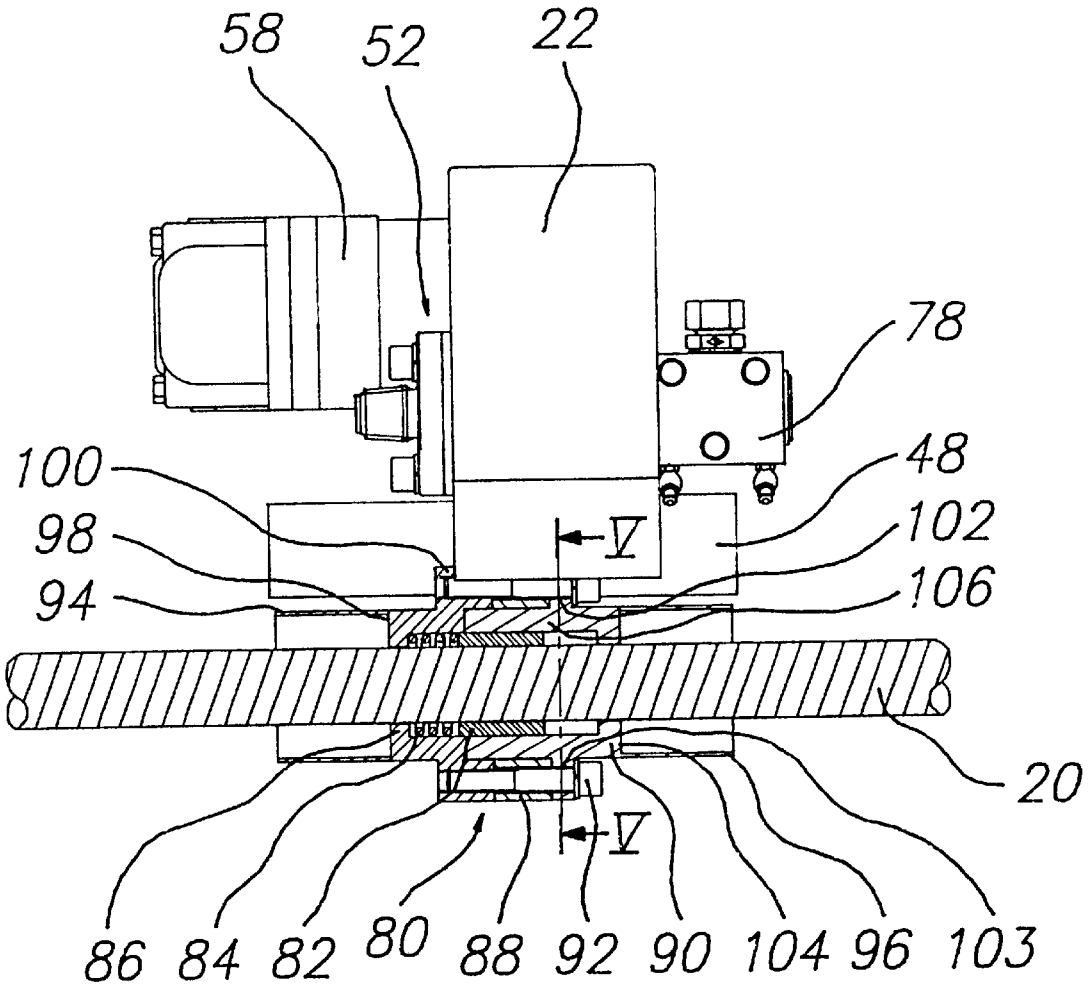
FIG. 4 an axial partial section of the slide shown in its rear stop position.

FIG. 4 shows by way of an axial partial section of the slide 22 its support on the forward feed spindle. First one sees in non-sectional illustration the upper section of the slide body having on its forward side the rod receiver 52 extending in the forward feed direction as well as the rotary drive motor 58, and on its rear side having a housing 78 for connection with flushing water conductors. The housing 78 has a sealed, rotatably supported inner shaft (not illustrated) which is connected with the boring rod through the rod receiver. The hollow cylinder 48 extends in the axial direction to both sides of the slide 22. In sectional illustration is shown a support housing 80 arranged on the lower section of the slide 22, which housing 80 surrounds the forward speed spindle 20, a spindle nut 82 supported on the spindle, and a helical spring 84. The support housing 80 has a cylindrical outer profile and is made up of three housing parts; namely, a forward housing body 86 rigidly formed on the slide 22; an intermediate ring 88; and a rear housing body 90. The three housing parts are connected by screws 92.

At both axial ends of the support housing 80 are formed tubular supports 94 and 96, which extend in the axial direction. During operation of the earth boring machine on each of the supports 94 and 96, a portion of the cover 42, illustrated in FIG. 2, is supported.

The forward housing body 86 has a forward wall 98 with a circular shaped opening in its middle, the edge of which closely surrounds the forward feed spindle 20. Forwardly of the intermediate ring 88, the outer and inner profile of the forward housing body widens step-wise to a flange 100. The intermediate ring 88 lies on the flange 100, and the intermediate ring in turn, lies on outer ring flange 100 fixedly formed on the rear housing body 90. The flange 100, the intermediate ring 88, and the ring flange 102 have bores 103 for receiving the screw 92. The rear housing body 90 has a rear wall 104 with a circular opening in its middle, which closely surrounds the forward feed spindle 20. With its side wall 106, the rear housing body 90 is received in the interior of the forward housing body 86 and forms together with this a stepless inner profile of the support housing 80, which closely surrounds the spindle nut 82 at its circumference. In the axial direction, the support housing 80 has play room for movement of the spindle nut 82 between the forward wall 98 and the rear wall 104. A movement of the spindle nut 82 in the direction toward the forward wall 98 takes place against a force of the intermediately supported helical spring 84 which is formed as a compression spring.

Figure 5:
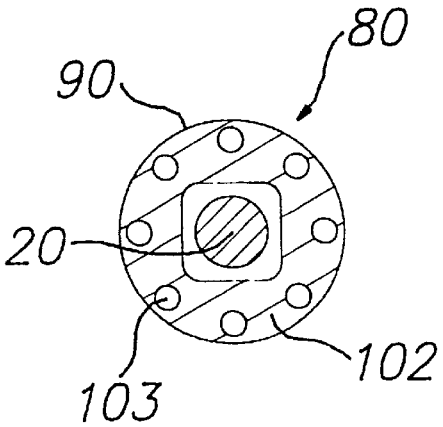
FIG. 5 a radial section taken along the line V—V in FIG. 4.

FIG. 5 shows a radial section of the support housing 80 and of the forward feed spindle along the line V—V of FIG. 4. The support housing 80 as seen in this transverse section has a nearly rectangular inner profile.

Figure 6:
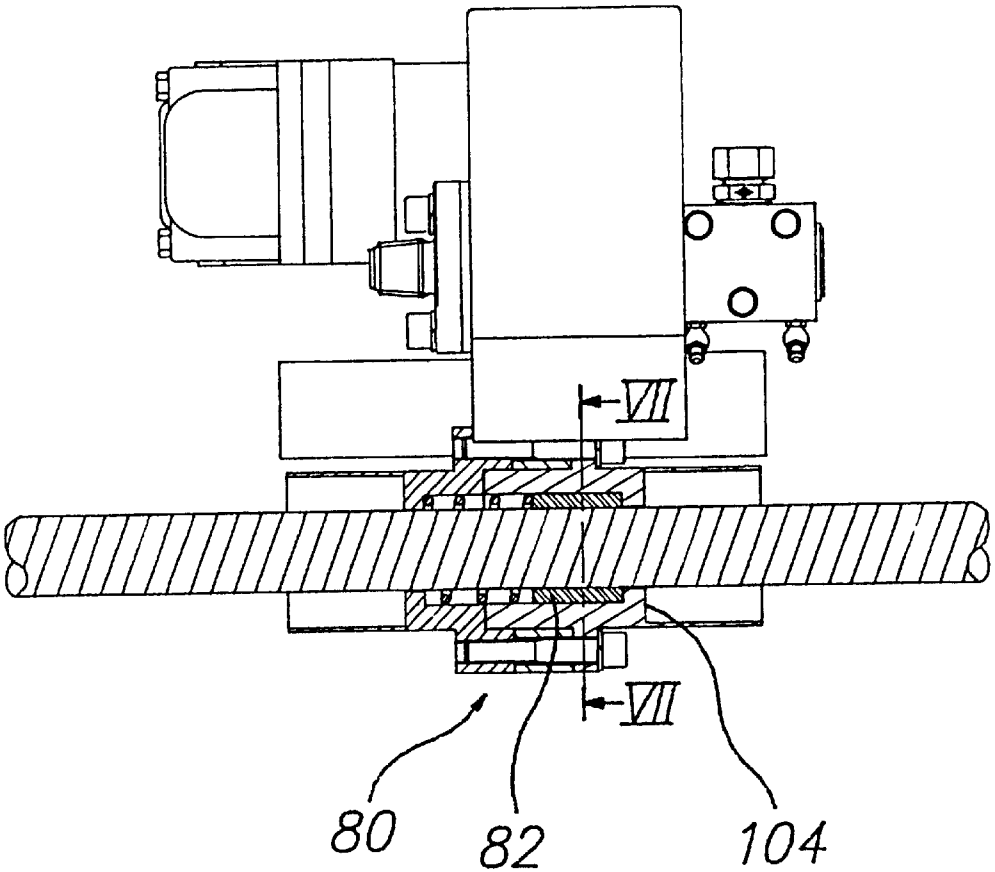
FIG. 6 an axial partial section of the slide in its forward stop position.

FIG. 6 shows a partial axial section of the slide 20 in its forward stop position. FIG. 6 differs from FIG. 4 in regard to the position of the spindle nut 82 inside of the support housing 80. The spindle nut is contact with the rear wall 104 so that the helical spring 84 is unloaded.

Figure 7:
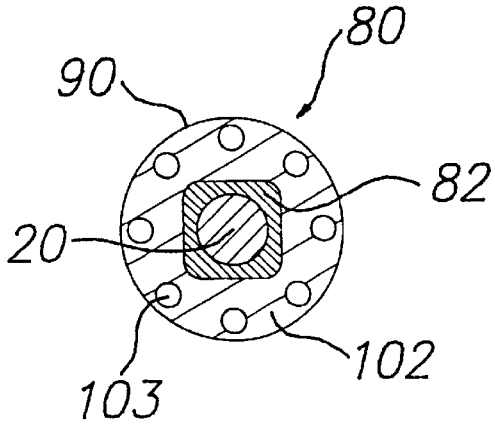
FIG. 7 a radial section taken along the line VII—VII in FIG. 6.

FIG. 7 shows a radial section along the line VII—VII in FIG. 6. The inner profile of the support housing 80 surrounds the spindle nut 82 so that it is supported in rotatably fixed condition but is axially movable with rotation of the forward feed spindle 20.

What is claimed is:

1. An earth boring mechanism with a frame (18) and a slide (22) linearly movable on the frame, the slide having an apparatus for holding (52,54,56) and for rotatably driving (58) a boring rod (24), and with a forward feed drive (60,62,64,66,68,70) for moving the slide (22) parallel to a boring direction, the forward drive (60,62,64,66,68,70) having a rotationally drivable forward feed spindle (20) arranged on the frame (18), which spindle is received in a spindle nut (82) non-rotatably connected with the slide (22), the slide (22) being movable relative to the spindle nut (82) along an axial stretch of the spindle which stretch of movement is limited by stops (98,104) fixed to the slide, the slide (22) being biased by a biasing element axially toward one of said stops, and said biasing element being a helical spring (84) designed as a compression spring which surrounds the forward feed spindle (22) and works between said spindle nut (82) and one of the axial stops (98,104).

2. An earth boring mechanism according to claim 1, wherein the spindle nut (82) is arranged in a housing (80) fixed to the slide (22), with the housing having axial end faces (98,104) constituting said stops.

3. An earth boring mechanism according to claim 1, wherein the slide (22) is biased in the direction of the forward feed of the boring rod (24).

4. An earth boring machine according to claim 1, wherein said forward feed spindle has a longitudinal axis, and the forward feed drive includes a forward feed motor (70) for the rotational drive of the forward feed spindle (20) arranged laterally of the longitudinal axis of the forward feed spindle and connected with the forward speed spindle (20) through a drive (60,62,64,66).

5. An earth boring machine according to claim 4, wherein the forward feed motor (70) is an hydraulic motor.

6. An earth boring machine according to claim 1, wherein the forward feed spindle (20) is surrounded by a concave cone spring.

7. An earth boring machine according to claim 1 wherein the forward feed spindle (20) is surrounded by a bellows.

* * * * *